US007470868B2

(12) United States Patent
Lin et al.

(10) Patent No.: US 7,470,868 B2
(45) Date of Patent: Dec. 30, 2008

(54) SWITCH WITH LIGHT EMITTING FUNCTION

(75) Inventors: Shih-An Lin, Taipei County (TW); Chi-Pao Huang, Taoyuan County (TW)

(73) Assignee: Qisda Corporation, Taoyuan County (TW)

( * ) Notice: Subject to any disclaimer, the term of this patent is extended or adjusted under 35 U.S.C. 154(b) by 37 days.

(21) Appl. No.: 11/620,109

(22) Filed: Jan. 5, 2007

(65) Prior Publication Data

US 2007/0167057 A1 Jul. 19, 2007

(30) Foreign Application Priority Data

Jan. 19, 2006 (TW) ..... 95102126 A

(51) Int. Cl.
*H01H 9/00* (2006.01)

(52) U.S. Cl. ..... 200/314; 200/341

(58) Field of Classification Search ..... 200/310–317, 200/341–345

See application file for complete search history.

(56) References Cited

U.S. PATENT DOCUMENTS 4,028,515 A * 6/1977 Desio et al. ..... 200/317
4,075,449 A * 2/1978 Yagi et al. ..... 200/315
4,082,934 A * 4/1978 Piber ..... 200/315
4,115,673 A * 9/1978 Smith ..... 200/315
4,160,972 A * 7/1979 La Mell et al. ..... 340/541
4,172,973 A * 10/1979 Sano ..... 200/315
4,371,759 A * 2/1983 Clark, Jr. ..... 200/5 R
4,409,644 A * 10/1983 Axton et al. ..... 362/200
4,431,879 A * 2/1984 Fujita et al. ..... 200/314
4,631,377 A * 12/1986 Imazeki et al. ..... 200/313
4,814,566 A * 3/1989 Sigl ..... 200/305
4,851,623 A * 7/1989 Honda et al. ..... 200/314
4,868,384 A * 9/1989 Franken et al. ..... 250/229
5,036,441 A * 7/1991 Herron ..... 362/95
5,285,038 A * 2/1994 Asher et al. ..... 200/314
5,391,848 A * 2/1995 Murphy ..... 200/314
6,522,147 B1 * 2/2003 Pickard et al. ..... 324/414
6,670,567 B1 * 12/2003 Koseki et al. ..... 200/564
6,747,226 B2 * 6/2004 Watanabe ..... 200/520
6,969,811 B1 * 11/2005 Lai ..... 200/86.5
7,104,677 B2 * 9/2006 Barlian et al. ..... 362/545
7,235,754 B2 * 6/2007 Rochon et al. ..... 200/406
7,244,898 B2 * 7/2007 Kim ..... 200/314
7,253,369 B2 * 8/2007 Fu et al. ..... 200/310
7,312,413 B2 * 12/2007 Liang ..... 200/314
7,331,805 B1 * 2/2008 Hu ..... 439/188

* cited by examiner

*Primary Examiner*—Michael A Friedhofer
*Assistant Examiner*—Lisa N Klaus

(57) ABSTRACT

A switch with light emitting function is provided. The switch is disposed on a circuit board for starting a device, and includes a case, a button, a light emitting diode (LED) and a number of pins. The button is protruded from the case. The LED is disposed inside the case, and has a positive end and a negative end. The pins are connected to a first electrical contact, a second electrical contact, a third electrical contact and the negative end of the LED, respectively. The positive end of the LED is electrically connected to the fourth electrical contact. When the button is pressed, the first electrical contact and the second electrical contact are shorted to start the device. Meanwhile, the third electrical contact and the fourth electrical contact are shorted, so that the LED is turned on to emit a light. No extra space is needed for disposing the LED.

8 Claims, 3 Drawing Sheets

SWITCH WITH LIGHT EMITTING FUNCTION

This application claims the benefit of Taiwan application Serial No. 95102126, filed Jan. 19, 2006, the subject matter of which is incorporated herein by reference.

BACKGROUND OF THE INVENTION

1. Field of the Invention

The invention relates in general to a switch, and more particularly to a switch with light emitting function.

2. Description of the Related Art

Many electronic appliances and products need a switch. The electronic appliances and products start to operate when the switch is pressed. Normally, there is an LED disposed next to the switch. When the switch is pressed, the LED is turned on to emit a light to remind the user with regard to whether the electronic product or the electronic appliance is started.

Referring to both FIG. 1A and FIG. 1B, FIG. 1A shows a perspective view of a conventional switch, and FIG. 1B shows a block diagram of a switch and an LED circuit. The computer is taken for an example. The circuit board 100 of a computer is normally disposed with a switch 101. When the user would like to use the computer, the user has to press the power switch 101. The switch 101 turns on the conducting wire 102, so that one end of the conducting wire 102 is connected to a low voltage, and the other end is connected to a signal receiving end 105. The signal receiving end 105 sends a signal S1 to a controlling circuit 109 after having received a low voltage signal. The controlling circuit 109 sends a controlling signal S2 to turn on a VCC power 106 for outputting a high voltage after having received the signal S1. The VCC power 106 generates a current, which flows to the negative end of the LED 103 from the positive end of the LED 103. When the current flows through the LED 103, the LED 103 emits a light to inform the user that the power is started already.

However, the design of conventional switch and LED wastes too much space. As the specifications of many electronic appliances and products are getting smaller and smaller to save space, the usable area of the circuit board 100 is also reduced. Therefore, how to reduce the size of the switch with respect to the circuit board 100 has become an important issue to be resolved.

SUMMARY OF THE INVENTION

It is therefore an object of the invention to provide a switch capable of saving space for the circuit board, meanwhile, the switch has the function of reminding and informing the user with regard to whether the switch is started.

The invention achieves the above-identified object by providing a switch with light emitting function. The switch is disposed on a circuit board for starting a device and includes a case, a button, a light emitting diode (LED) and a number of pins. The button is protruded from the case. The LED is disposed inside the case and has a positive end and a negative end. The pins are respectively connected to a first electrical contact, a second electrical contact, a third electrical contact and the negative end of the LED. The positive end of the LED is electrically connected to the fourth electrical contact. When the button is pressed, the first electrical contact and the second electrical contact are shorted to start the device. Meanwhile, the third electrical contact and the fourth electrical contact are shorted, so that the LED is turned on to emit a light. No extra space is needed for disposing the LED.

The invention achieves another object by providing a circuit board. The circuit board includes a body and a switch. The switch is disposed on the body and includes a case, a button, a light emitting diode (LED) and a number of pins. The button is protruded from the case. The LED is disposed inside the case for emitting a light. The LED has a positive end and a negative end. The pins are electrically connected to a first electrical contact and a second electrical contact respectively, and another two pins are electrically connected to a third electrical contact and the negative end of the LED respectively. The positive end of the LED is electrically connected to the fourth electrical contact. When the button is pressed, the first electrical contact and the second electrical contact are shorted to start the device. Meanwhile, the third electrical contact and the fourth electrical contact are shorted, so that the LED is turned on to emit a light. No extra space is needed for disposing the LED.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1A:
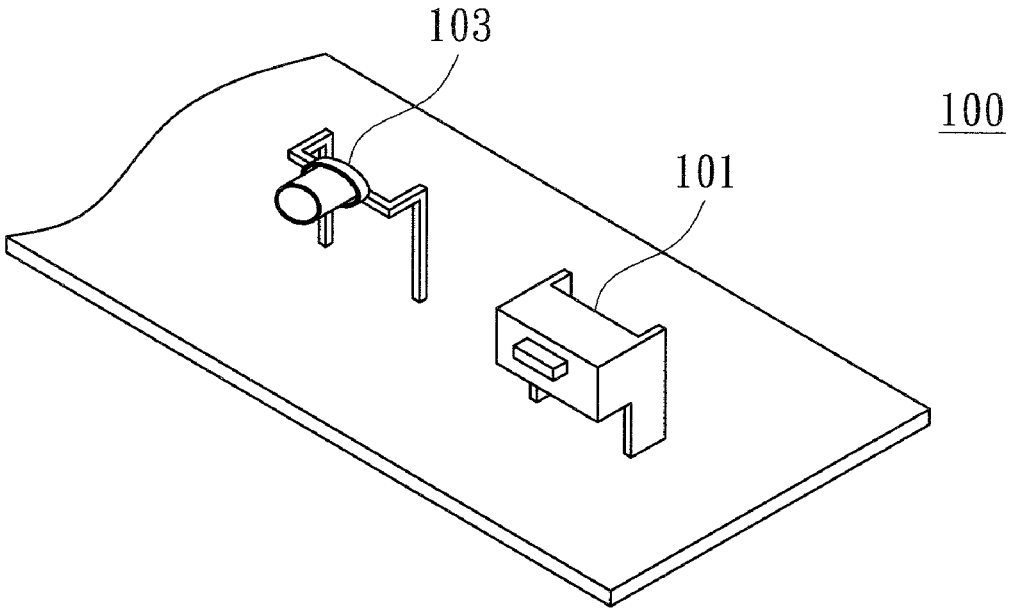
FIG. 1A(PRIOR ART)
FIG. 1A (PriorArt) shows a perspective view of a conventional switch.
Figure 1B:
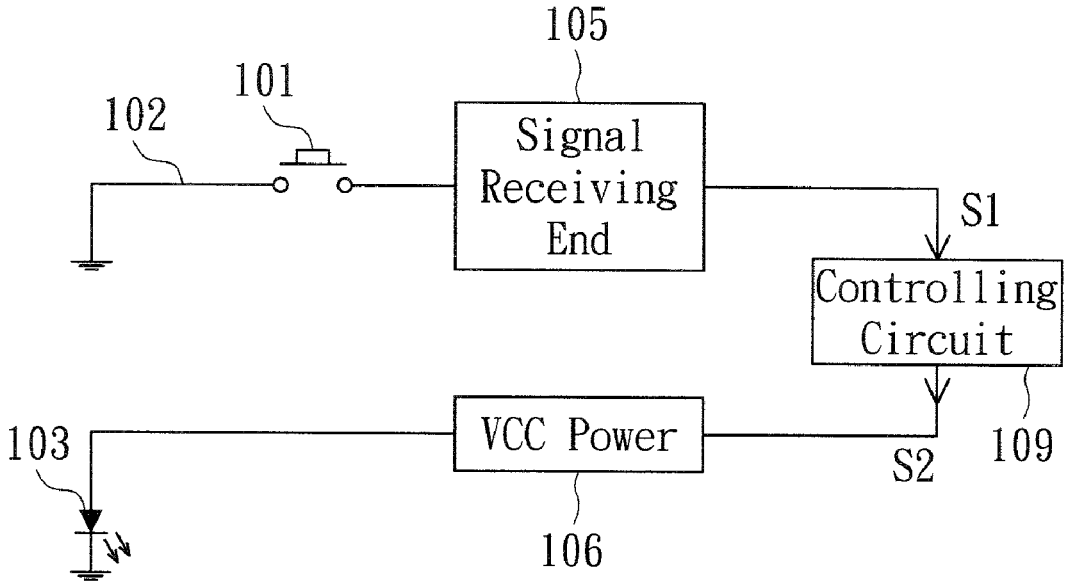
FIG. 1B(PRIOR ART)
FIG. 1B (PriorArt) shows a block diagram of a switch and an LED circuit.
Figure 2A:
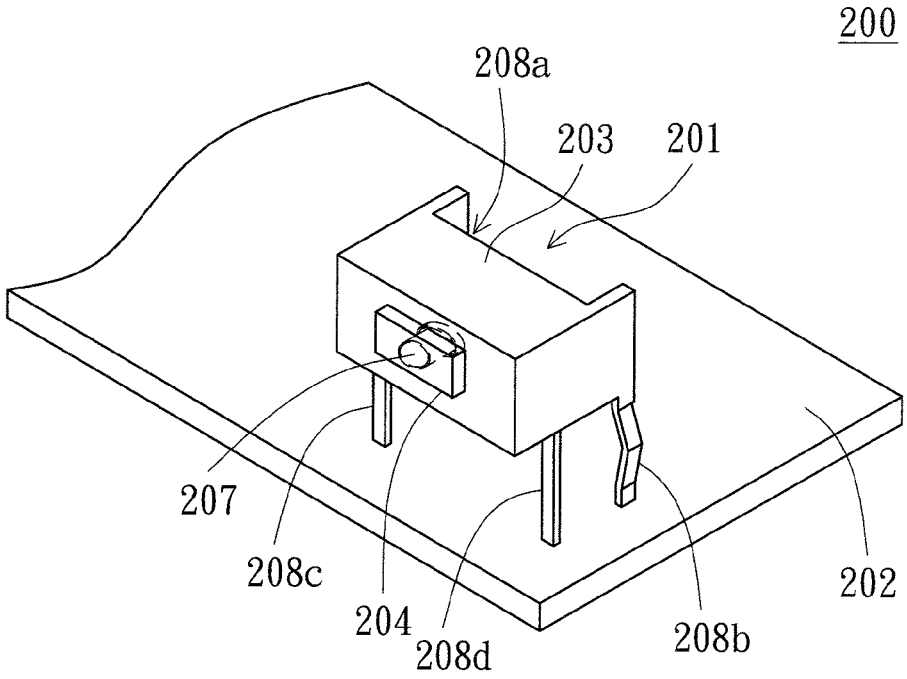
FIG. 2A shows a perspective view of a circuit board.
Figure 2B:
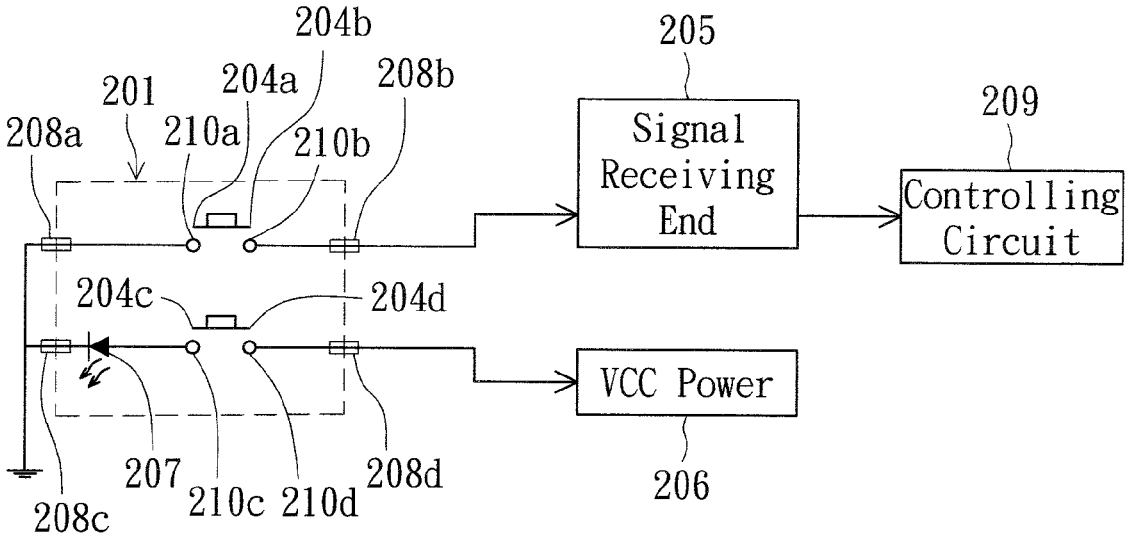
FIG. 2B shows a circuit diagram according to a preferred embodiment of the invention.
Figure 2C:
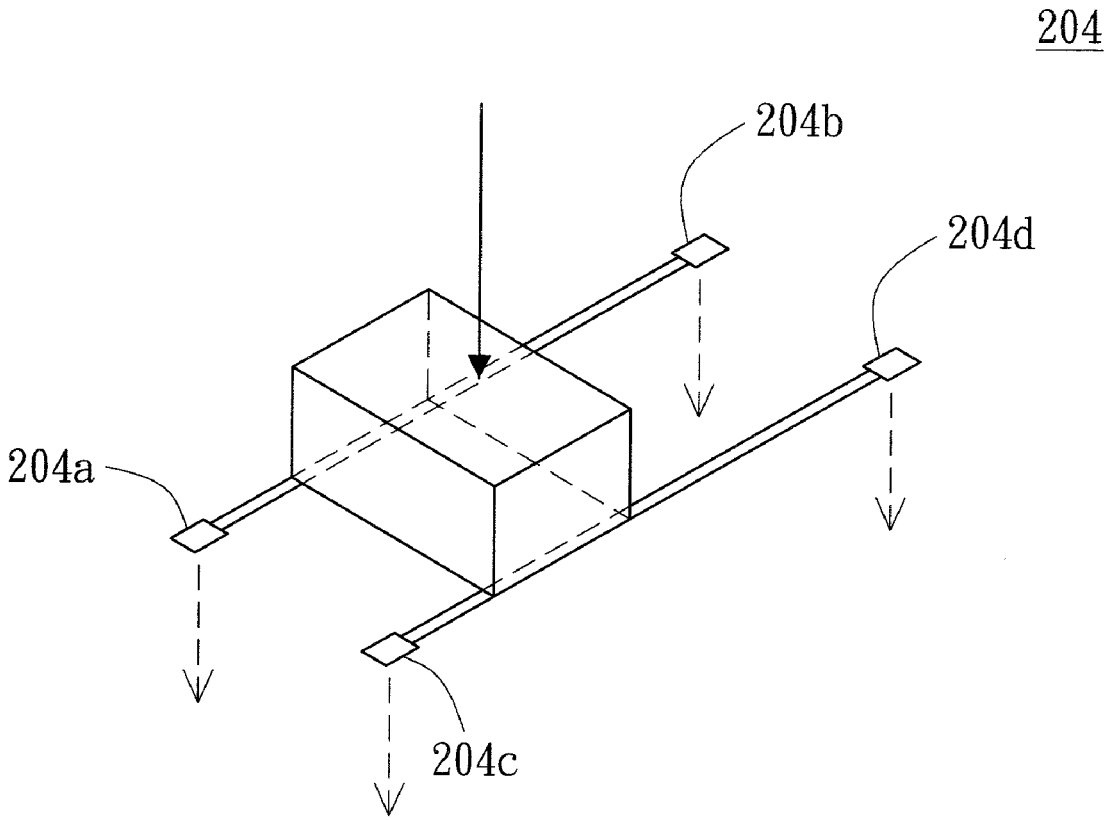
FIG. 2C shows a perspective view of a button.

Referring to FIG. 2A, FIG. 2B and FIG. 2C at the same time, FIG. 2A shows a perspective view of a circuit board, FIG. 2B shows a circuit diagram according to a preferred embodiment of the invention, and FIG. 2C shows a perspective view of a button. The circuit board 200 includes a body 202 and a switch 201. The switch 201 is disposed on the body 202. The switch 201 includes a case 203, the button 204, a number of pins and a light emitting diode (LED) 207. The button 204 is disposed on and protruded from the case 203. The LED 207 is disposed inside the case 203 and has a positive end and a negative end. The pins are exemplified by a first pin 208*a*, a second pin 208*b*, a third pin 208*c* and a fourth pin 208*d*. The first pin 208*a* and the second pin 208*b* is soldered onto the solder pin of the circuit board 200 and electrically connected to a first electrical contact 210*a* and a second electrical contact 210*b* respectively. The third pin 208*c* and the fourth pin 208*d* are the pins of the LED 207 and electrically connected to a third electrical contact 210*c* and a fourth electrical contact 210*d* respectively.

Referring to FIG. 2B, the button 204 includes a first contact point 204*a*, a second contact point 204*b*, a third contact point 204*c* and a fourth contact point 204*d*. The first contact point 204*a* is for being electrically connected to the first electrical contact 210*a*. The second contact point 204*b* is for being electrically connected to the second electrical contact 210*b*. The third contact point 204*c* and the fourth contact point 204*d* are for being electrically connected to the third electrical contact 210*c* and the fourth electrical contact 210*d*, respectively.

The third electrical contact 210*c* is connected to one end (the positive end) of the LED 207, and the other end (the negative end) of the LED 207 is connected to the third pin 208*c*. The fourth electrical contact 210*d* is connected to the fourth pin 208*d*, and the fourth pin 208*d* is further connected to a high voltage VCC power. When the third electrical contact 210*c* is not electrically connected to the fourth electrical contact 210*d*, the two ends of the LED 207 are open-looped, and the current does not flow through the LED 207 so that the LED 207 will not emit a light. When the third electrical contact 210*c* and the fourth electrical contact 210*d* are electrically connected, that is, when the button is pressed, the first electrical contact 210*a* and the second electrical contact 210*b* are shorted. Meanwhile, the third electrical contact 210*c* and the fourth electrical contact 210*d* are also shorted and the voltage at the two ends of the LED 207 drops, so that the current will flow from the high voltage VCC power 206 to the low voltage grounding layer via the LED 207 for enabling the LED 207 to emit a light.

The case 203 or the button 204 can be made of a transparent material, such as transparent acrylic for example. When a light is emitted by the LED 207, the light can inform the user via a transparent case or button with regard to whether the electronic device is started. The first pin 208*a*, the second pin 208*b*, the third pin 208*c* and the fourth pin 208*d* are made of metal such as copper for example, so that the pins are electrically connected to the signal receiving end 205 or the VCC power 206. Such approach does not need to electrically connect the VCC power 206 with the controlling circuit 209, and by pressing the button 204, the electronic device is started and the LED 207 is turned on to emit a light at the same time.

When the button 204 is pressed again, the first electrical contact 210*a* and the second electrical contact 210*b* are disconnected, and so are the third electrical contact 210*c* and the fourth electrical contact 210*d* disconnected to turn off the power.

According to the switch disclosed in the above embodiment of the invention, the LED is disposed inside the switch. When the switch is turned on, the LED is turned on at the same time. The switch having the function of driving an electronic device and emitting a light does not have to dispose the LED and the switch respectively, thus saving more space for the circuit board. Under the current trend of miniaturization of electronic products, such switch is particularly suitable.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A switch with light emitting function disposed on a circuit board, wherein the switch is for starting a device and comprises:

a case;

a button protruded from the case, wherein the button comprises a first contact point, a second contact point, a third contact point and a fourth contact point;

a light emitting diode (LED) disposed inside the case, wherein the LED has a positive end and a negative end; and a plurality of pins electrically connected to a first electrical contact, a second electrical contact, a third electrical contact and the negative end of the LED respectively, and the positive end of the LED is electrically connected to a fourth electrical contact;

wherein when the button is pressed, the first electrical contact and the second electrical contact are shorted to start the device, meanwhile, the third electrical contact and the fourth electrical contact are shorted so that the LED is turned on to emit a light; and wherein when the button is pressed, the first contact point is electrically connected to the first electrical contact, the second contact point is electrically connected to the second electrical contact, the third contact point is electrically connected to the third electrical contact, and the fourth contact point is electrically connected to the fourth electrical contact.

2. The switch according to claim 1, wherein the LED is disposed inside the button.

3. The switch according to claim 1, wherein the case is transparent.

4. The switch according to claim 3, wherein the case is made of transparent acrylic.

5. A circuit board, comprising:

a body; and a switch disposed on the body, the switch comprising:

a case;

a button protruded from the case, wherein the button further comprises a first contact point, a second contact point, a third contact point and a fourth contact point;

a light emitting diode (LED), wherein part of the LED are disposed inside the case, and the LED has a positive end and a negative end; and a plurality of pins, wherein two of the pins are electrically connected to a first electrical contact and a second electrical contact respectively, another two pins are electrically connected to a third electrical contact and the negative end of the LED respectively, and the positive end of the LED is electrically connected to a fourth electrical contact;

wherein when the button is pressed, the first electrical contact and the second electrical contact are shorted to start the device, meanwhile, the third electrical contact and the fourth electrical contact are shorted, so that the LED is turned on to emit a light; and wherein when the button is pressed, the first contact point is electrically connected to the first electrical contact, the second contact point is electrically connected to the second electrical contact, the third contact point is electrically connected to the third electrical contact, and the fourth contact point is electrically connected to the fourth electrical contact.

6. The circuit board according to claim 5, wherein the LED is disposed inside the button.

7. The circuit board according to claim 5, wherein the case is transparent.

8. The circuit board according to claim 7, wherein the case is made of transparent acrylic.

* * * * *